US009519241B2

(12) United States Patent
Kitamura

(10) Patent No.: US 9,519,241 B2
(45) Date of Patent: Dec. 13, 2016

(54) DEVELOPMENT DEVICE, PROCESS CARTRIDGE, AND IMAGE FORMING APPARATUS

(71) Applicant: CANON KABUSHIKI KAISHA, Tokyo (JP)

(72) Inventor: Takuya Kitamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/842,698

(22) Filed: Sep. 1, 2015

(65) Prior Publication Data

US 2016/0070203 A1 Mar. 10, 2016

(30) Foreign Application Priority Data

Sep. 5, 2014 (JP) ..... 2014-181361

(51) Int. Cl.
*G03G 15/08* (2006.01)

(52) U.S. Cl.
CPC ..... *G03G 15/0817* (2013.01)

(58) Field of Classification Search
CPC ..... G03G 15/0881; G03G 15/0817
See application file for complete search history.

(56) References Cited

U.S. PATENT DOCUMENTS 6,405,003 B2 * 6/2002 Uehara ..... G03G 15/0817 399/103
2006/0078356 A1 * 4/2006 Inami ..... G03G 15/0812 399/274
2015/0185657 A1 * 7/2015 Matsui ..... G03G 9/0833 430/105
2015/0301495 A1 * 10/2015 Kawaguchi ..... G03G 21/1661 399/12

FOREIGN PATENT DOCUMENTS

JP 2004-264428 A 9/2004
JP 2005-181713 A 7/2005

* cited by examiner

*Primary Examiner* — G. M. Hyder
(74) *Attorney, Agent, or Firm* — Canon USA, Inc. IP Division

(57) ABSTRACT

A development device in which there is a lubricant opposite in polarity to a developer in a surface region of a developer bearing member contacting an image bearing member and an end seal when the developer bearing member rotates.

13 Claims, 10 Drawing Sheets

DEVELOPMENT DEVICE, PROCESS CARTRIDGE, AND IMAGE FORMING APPARATUS

BACKGROUND OF THE INVENTION

Field of the Invention

The present invention relates to a development device employing an electrophotographic system or an electrostatic recording system used as a copying machine or a printer, a process cartridge, and an image forming apparatus.

Description of the Related Art

Conventionally, a contact development system has been employed as a system for developing a latent image in an electrophotographic apparatus such as a printer or a copying machine. In the contact development system, development is performed with an image bearing member (hereinafter referred to as a photosensitive drum) and a developer bearing member (hereinafter referred to as a development roller) contacting each other. The contact development system can produce a high-quality image output, and thus many image forming apparatuses based on this system have been proposed.

Some contact development systems include a configuration in which a photosensitive drum and a regulation member (hereinafter referred to as a development blade) rotate while in contact with a developer roller. In this configuration, the development roller may rotate with no coating of a developer (hereinafter referred to as toner) in an assembling process or in a situation of first-time use, for example. When the development roller rotates, sliding friction between the development roller and each of the photosensitive drum and the development blade occurs so that the surfaces of the development roller, the development blade, and the photosensitive drum are scratched, which may affect an image quality. To deal with such a problem, a configuration has been proposed in which a lubricant is previously borne on a surface of a development roller, as in Japanese Patent Application Laid-Open No. 2004-264428.

However, there still remains a problem in an apparatus in which an end seal contacts an end of the development roller for the purpose of preventing leakage of toner in a development container. The development roller contacting the end seal is not coated with the toner or the lubricant. Accordingly, when the end seal or the photosensitive drum slides relative to the development roller, the surface of the development roller may be cracked or scratched, and the toner may leak out via cracks or scratches.

To address this, means for previously applying a lubricant to an end seal has been discussed, as in Japanese Patent Application Laid-Open No. 2005-181713. However, the lubricant is conveyed from the end seal to a photosensitive drum via the development roller, so that there is no or very little lubricant remaining on the development roller. In such a state, when the end seal or the photosensitive drum slides relative to the development roller, as described above, a surface of the development roller may be cracked. Particularly, since prolonging of an apparatus life has been recently required, the possibility has increased that a lubricant amount remaining on the development roller decreases in the apparatus life.

SUMMARY OF THE INVENTION

The present invention is directed to providing a development device that reduces the possibility that a surface of a developer bearing member is cracked or scratched which causes toner to leak out via the cracks or scratches.

According to an aspect of the present invention, a development device includes a developer bearing member arranged to contact an image bearing member and configured to convey a developer, a development container configured to contain the developer, and an end seal configured to contact the developer bearing member to prevent the developer from leaking from between an end of the developer bearing member in a longitudinal direction and the development container in which a surface of the developer bearing member contacts the image bearing member and the end seal in a case where the developer bearing member rotates and there is a lubricant opposite in polarity to the developer on at least the surface of the developer bearing member. In addition, the present invention provides a process cartridge and an image forming apparatus.

Further features of the present invention will become apparent from the following description of exemplary embodiments with reference to the attached drawings.

DESCRIPTION OF THE EMBODIMENTS

A first exemplary embodiment of the present invention will be described below. Exemplary embodiments of the present invention will be specifically described with reference to the drawings. However, sizes, qualities, and shapes of components and their relative arrangement described in the present exemplary embodiments are to be changed, as needed, depending on a configuration and various conditions of an apparatus to which the present invention is applied, and a scope of the present invention is not to be limited to exemplary embodiments, described below.

<Image Forming Process>

Figure 1:
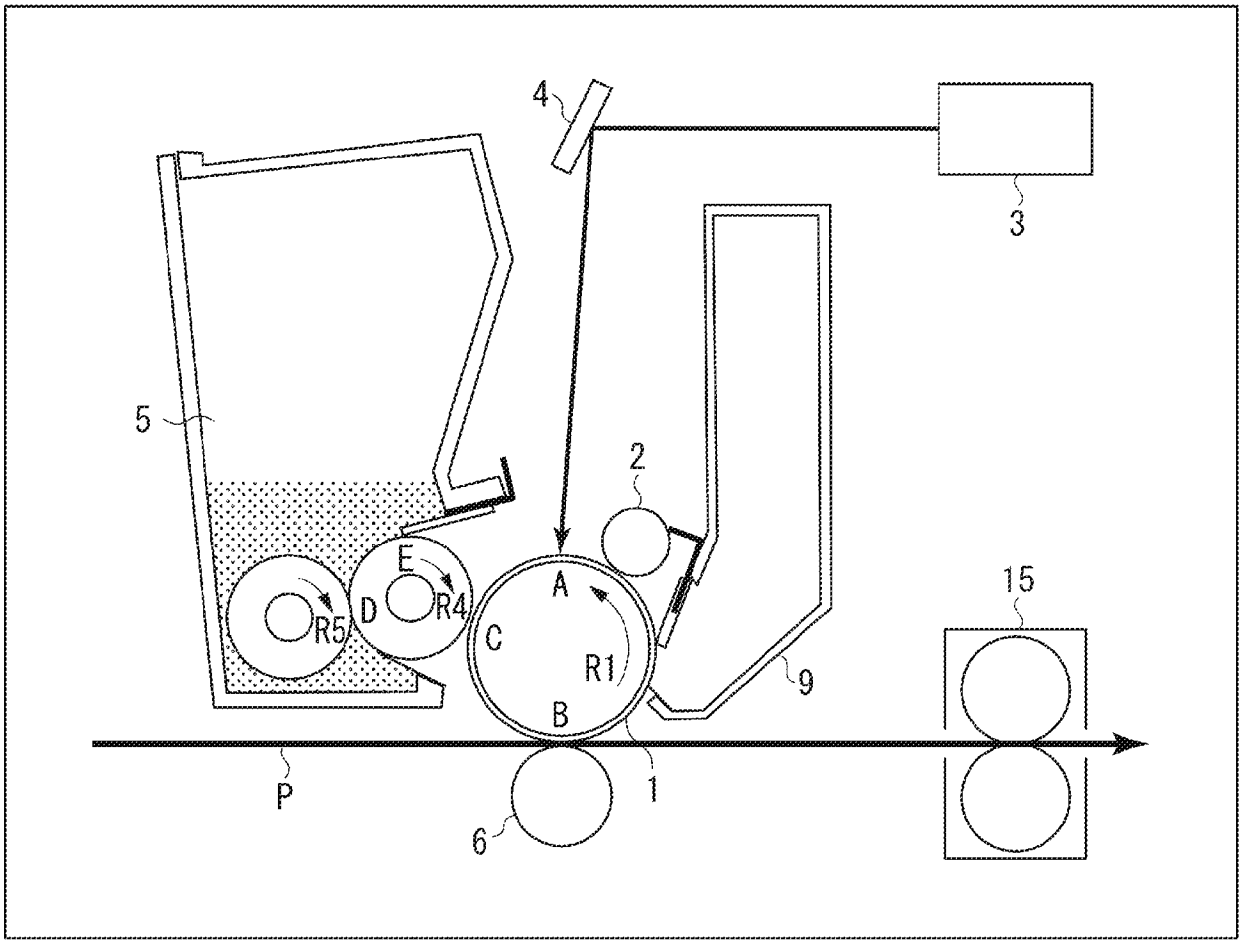
FIG. 1 is a schematic sectional view of an image forming apparatus according to a first exemplary embodiment.

A configuration of an image forming apparatus according to the present exemplary embodiment is illustrated in FIG. 1.

A charging roller 2 charges the surface of a photosensitive drum 1 functioning as an image bearing member, which rotates at a speed of 100 mm/sec in the direction indicated by an arrow R1, at a predetermined potential. At an exposure position A, a laser beam, which has been transmitted from an exposure device 3 in response to an image signal, forms an electrostatic latent image on the photosensitive drum 1 via a reflection mirror 4. A development device 5 develops the formed electrostatic latent image at a development position C, to form a toner image. The toner image formed on the photosensitive drum 1 is transferred onto a transfer material P at a transfer position B where the photosensitive drum 1 and a transfer roller 6 oppose each other. The transfer material P such as paper on which the toner image has been transferred is sent to a fixing device 15. The fixing device 15 presses and heats the toner image on the transfer material P to fix the toner image onto the transfer material P, to obtain a final image.

A cleaning device 9 is installed downstream of the transfer position B in a movement direction of the photosensitive drum 1. An accessory blade is arranged contacting the photosensitive drum 1 so as to scrape away toner on the photosensitive drum 1.

According to the present exemplary embodiment, negatively chargeable toner is used, and reversal development is performed for forming a toner image on an exposure portion on the photosensitive drum 1. However, the present invention is not limited to the negatively chargeable toner. Positively chargeable toner may be used in a different configuration.

According to the present exemplary embodiment, a process cartridge including the photosensitive drum 1 serving as an image bearing member is detachably attached to a main body of the image forming apparatus. However, the present invention is not limited to this configuration. A development device serving as a development unit may be detachably attached to a main body of the image forming apparatus. This development device does not include the photosensitive drum 1.

According to the present exemplary embodiment, the process cartridge integrally includes the photosensitive drum 1, the charging roller 2 serving as a charging unit, the development device 5 including a development container and a development roller, and the cleaning device 9 including a cleaning blade and a waste toner containing unit (FIG. 1).

<Development Process>

Figure 2:
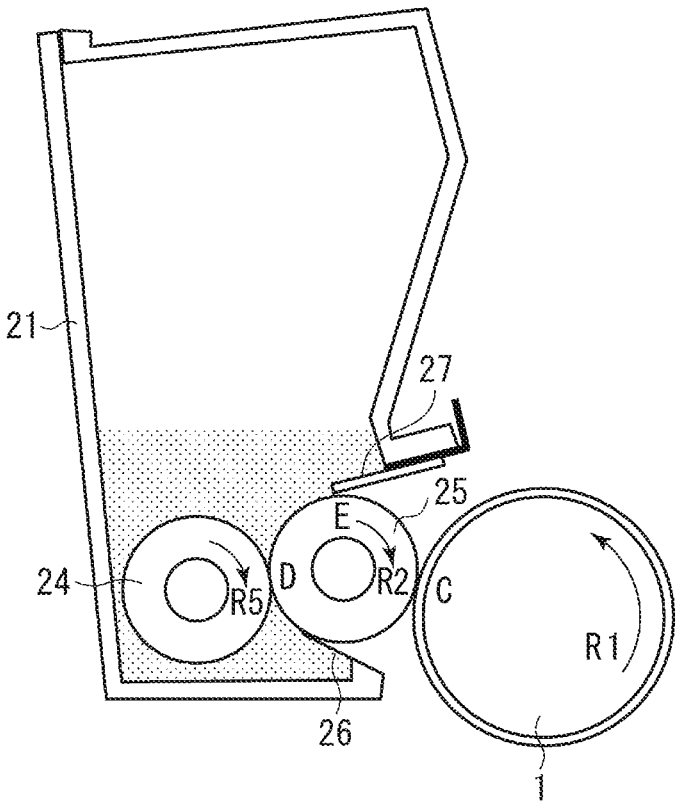
FIG. 2 is a schematic sectional view of a development device according to the first exemplary embodiment.

A development process will be described with reference to FIG. 2. Toner contained in a development container 21 is supplied to the surface of a development roller 25 serving as a developer bearing member from a supply roller 24 serving as a developer supply member. The toner which adheres to the surface of the development roller 25 is conveyed to a toner amount regulation position E by rotation of the development roller 25. The toner amount is controlled by a regulation blade 27 serving as a regulation member such that a proper toner amount (an amount of a developer or a thickness of a toner layer) is obtained. The toner with which the surface of the development roller 25 has been coated is developed at a development position C into an image corresponding to an electrostatic latent image formed on a surface of the photosensitive drum 1. The toner remaining on the surface of the development roller 25, which has not been used for development, returns to a supply position D again.

<Development Device>

The development device 5 will be specifically described with reference to FIG. 2.

The development device 5 includes the development container 21 containing toner, the development roller 25 disposed in an opening of the development container 21, a regulation blade 27, and a supply roller 24 provided so as to contact the development roller 25.

The development roller 25 rotates while contacting the photosensitive drum 1 during a development operation.

The development roller 25 includes a conductive cored bar having an outer diameter of ø8 (mm) and a conductive elastic layer having silicon rubber formed around the conductive cored bar as a basic layer. A surface layer is coated with an acrylic/urethane rubber layer. An outer diameter of the development roller 25 is ø13 (mm). During the development operation, the development roller 25 contacts the photosensitive drum 1 at the above described development position C, and is supported on the development container 21 so that it can be driven to rotate in a direction indicated by an arrow R2.

The supply roller 24 includes a conductive cored bar having an outer diameter of ø6 (mm) and a soft urethane sponge layer which has a continuous foam structure and is formed around the conductive cored bar. The outer diameter of the supply roller 24 is ø15 (mm). By employing a urethane sponge having a continuous foam structure, the supply roller 24 can store toner within the urethane sponge. During the development operation, the supply roller 24 contacts the development roller 25 at the supply position D, and is supported on the development container 21 so that it can be driven to rotate in the direction indicated by an arrow R5.

The regulation blade 27 is made of a stainless steel (SUS) having flexibility, and has its one end fixed to a supporting plate and the other end abutting on the development roller 25 as a free end. The supporting plate is fixed to the development container 21. The regulation blade 27 is disposed such that its smooth surface near the free end rubs the surface of the development roller 25 at a toner amount regulation position in a counter direction of a rotational direction of the development roller 25.

Figure 3:
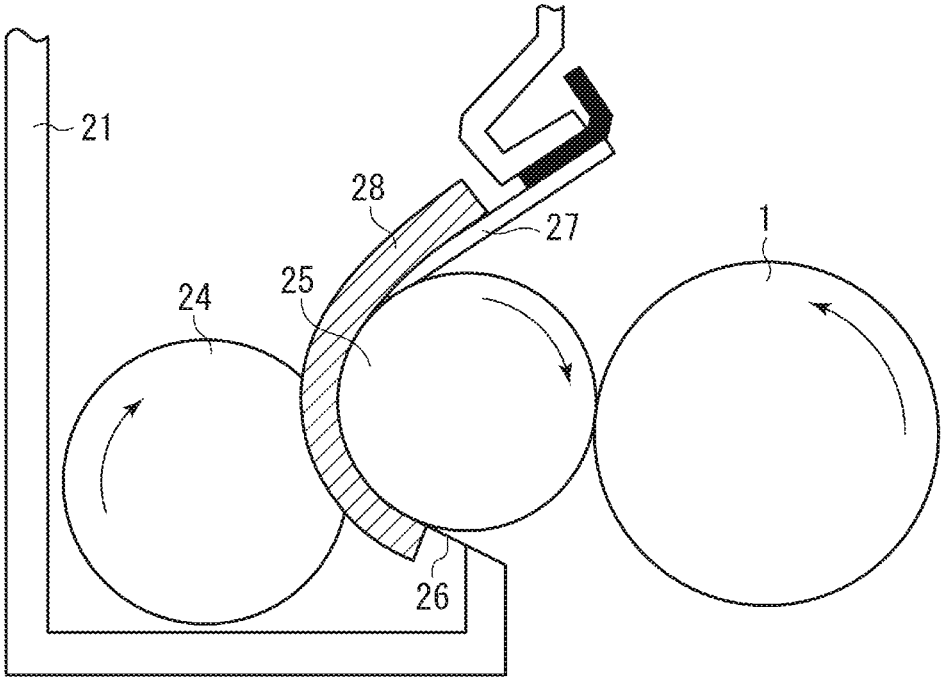
FIG. 3 is a schematic sectional view around a longitudinal end of a development roller according to the first exemplary embodiment.

FIG. 3 illustrates a configuration around an end in a longitudinal direction of the development roller 25 viewed from its side surface. An end seal 28 contacts a peripheral surface of the development roller 25 at both ends in the longitudinal direction under predetermined pressure to prevent toner at an end of the development container 21 from leaking. A leakage prevention seal 26 is provided along the longitudinal direction of the development roller 25, to prevent toner leakage through a space between the development container 21 and the development roller 25.

Figure 4:
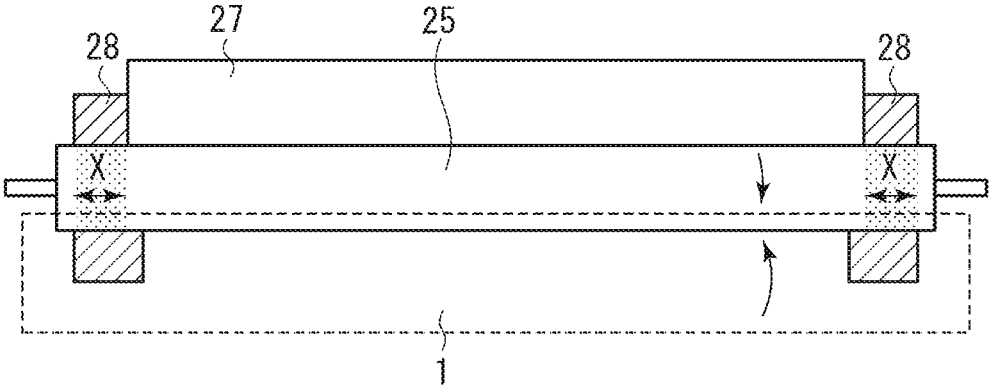
FIG. 4 illustrates an example of a lubricant application (coating) region around the development roller according to the first exemplary embodiment.

A lubricant will be described with reference to FIG. 4. FIG. 4 illustrates a configuration around the development roller 25. The end seal 28 contacts a peripheral surface at the end of the development roller 25 and at ends of the regulation blade 27 under predetermined pressure. The photosensitive drum 1 is longer in the longitudinal direction than the end seal 28, and contacts the development roller 25, as indicated by a dotted line in FIG. 4. When the photosensitive drum 1 slides at a position where no toner exists on the development roller 25, the surface of the development roller 25 may be cracked as described above. In a configuration where the regulation blade 27 and the end seal 28 overlap each other as illustrated in FIG. 4, a region corresponding to the contact width between the development roller 25 and the regulation blade 27 is coated with toner. Accordingly, in a region where the photosensitive drum 1 and the end seal 28 contact the development roller 25 and do not contact the regulation blade 27, no toner exists. Thus, the surface of the development roller 25 may be cracked by the sliding. In a configuration according to the present exemplary embodiment, a problem may occur in an X portion illustrated in FIG. 4. Therefore, according to the present exemplary embodiment, at least a peripheral surface of the X portion in the development roller 25 is previously coated with the lubricant. According to the present exemplary embodiment, an employed lubricant is urethane particles having a positive polarity which is opposite to that of toner (product name: "UCN5070D Clear" manufactured by Dainichiseika Color & Chemicals Mfg. Co., Ltd. having a mass average particle diameter of 7.2 μm). It is only required that the lubricant has particles opposite in polarity to the toner which is charged regularly when the image formation is performed, and thus a particle diameter, a degree of circularity, and a hardness are not limited to particular values. Further, for lubricant having particles that are opposite in polarity to the toner particles, the lubricant may have the same polarity as that of the regular toner after being processed using an external additive or a processing agent. Thus, the sliding is reduced by coating the X portion with the lubricant to prevent the surface of the development roller 25 from being cracked.

Figure 5:
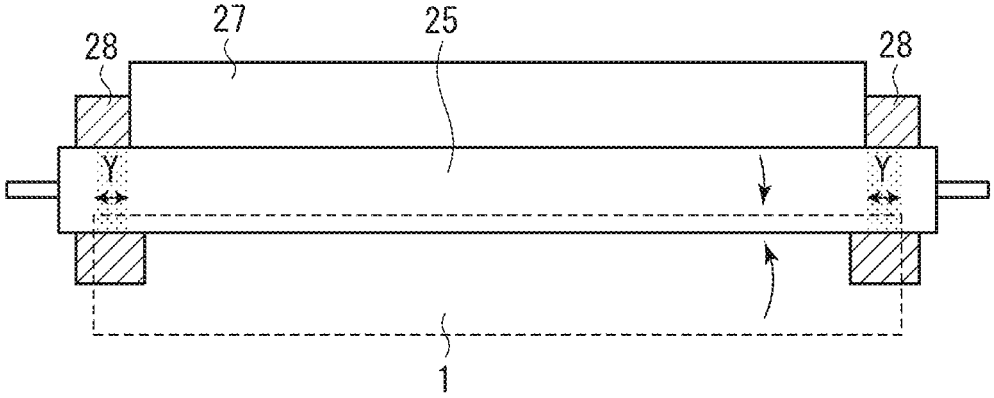
FIG. 5 illustrates another example of the lubricant application region around the development roller according to the first exemplary embodiment.

A longitudinal configuration in which an end of the photosensitive drum 1 is at a position corresponding to the end seal 28 will be described with reference to FIG. 5. In this case, there is a surface region of the development roller 25 that contacts the photosensitive drum 1 and the end seal 28. Further, there is a surface region of the development roller 25 that does not contact the regulation blade 27. These surface regions (a peripheral surface of a Y portion) of the development roller 25 should be coated with at least the lubricant.

Figure 6:
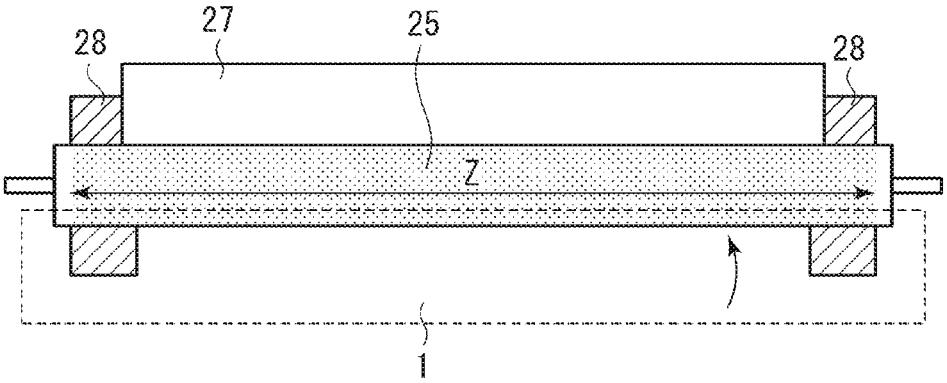
FIG. 6 illustrates still another example of the lubricant application region around the development roller according to the first exemplary embodiment.

Furthermore, it is required to coat with the lubricant at least at the surface region of the development roller 25 where the development roller 25 contacts the photosensitive drum 1 and the end seal 28 and does not contact the regulation blade 27. However, the region to be coated with the lubricant is not limited to only this region. Other regions may be coated with the lubricant. In FIG. 6, a longitudinal region including the X portion illustrated in FIG. 4 and an image forming region (a Z portion illustrated in FIG. 6) are coated with the lubricant. There is an advantage even when an area inside the end seal 28 is also previously coated with the lubricant before toner is conveyed to the development roller 25. This is effective in reducing an increase in driving torque caused by the regulation blade 27, the supply roller 24, and the photosensitive drum 1 while contacting the development roller 25 at the time of first use. Since particles opposite in polarity to the toner are used as the lubricant, even if the development roller 25 is coated with the lubricant with the toner and the lubricant mixed with each other during use, the lubricant reacts with an electric field opposite to the toner. Thus, at a development position, the toner is developed and the lubricant is not developed in an image formation electric field. On the other hand, the toner is not developed and the lubricant is developed in a non-image formation electric field. Therefore, developability of the toner is not disturbed.

<Potential Control>

Figure 7:
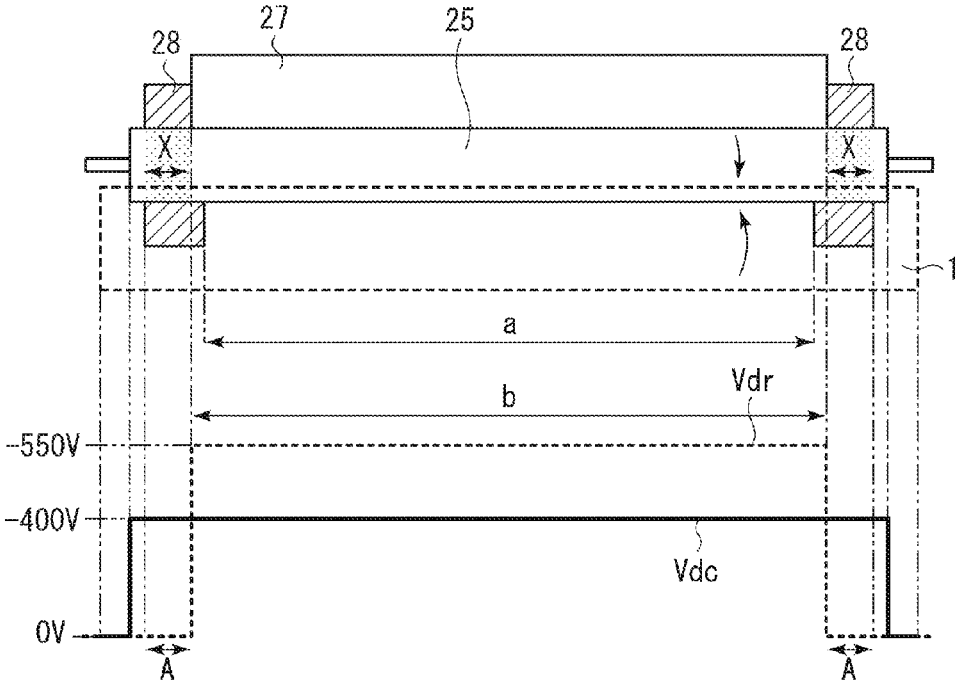
FIG. 7 illustrates an example of a longitudinal potential relationship according to the first exemplary embodiment.

Potential control (a potential change) during an image forming operation according to the present exemplary embodiment will be described with reference to FIG. 7. FIG. 7 illustrates a potential relationship during non-image formation in the above described longitudinal relationship illustrated in FIG. 4. An X portion in an upper part of FIG. 7 represents a region coated with a lubricant having a positive polarity, as with the X portion illustrated in FIG. 4. An A portion in a lower part of FIG. 7 shows a potential relationship corresponding to the X portion illustrated in FIG. 7.

Vdc represents a development bias which is applied to the development roller 25 and a surface potential of the development roller 25. According to the present exemplary embodiment, −400 V is applied as the development bias, and a uniform potential of −400 V is formed on an entire width of the development roller 25 including the X portion.

Vdr represents a surface potential of the photosensitive drum 1. According to the present exemplary embodiment, a region where the photosensitive drum 1 is charged by a charging roller (not illustrated) is indicated by an arrow b illustrated in FIG. 7. The surface potential Vdr of the photosensitive drum 1 in the charging region b is −550 V during non-image formation. The surface potential Vdr of the photosensitive drum 1 outside the charging region b becomes zero V. Accordingly, the surface potential Vdc of the development roller 25 and the surface potential Vdr of the photosensitive drum 1 in the A portion are respectively −400 V and zero V, and a potential difference therebetween is Vdr−Vdc=+400V. When the potential difference has the same polarity as that of the lubricant, the lubricant coated the X portion on the development roller 25 remains on the development roller 25 without being developed onto the photosensitive drum 1. When the A portion is thus controlled so as to obtain a potential relationship in which the lubricant having a positive polarity is not developed onto the photosensitive drum 1, the lubricant remains in the X portion, reducing the sliding. Thus, the surface of the development roller 25 can be inhibited from being cracked. Therefore, a high-quality image output can be obtained over a long period of time.

FIG. 7 illustrates the potential relationship at the ends of the development roller 25, and does not illustrate a potential relationship corresponding to an image formation region a. Therefore, the potential relationship in the image formation region a does not limit the present exemplary embodiment regardless of whether it is during image formation or non-image formation.

Figure 8:
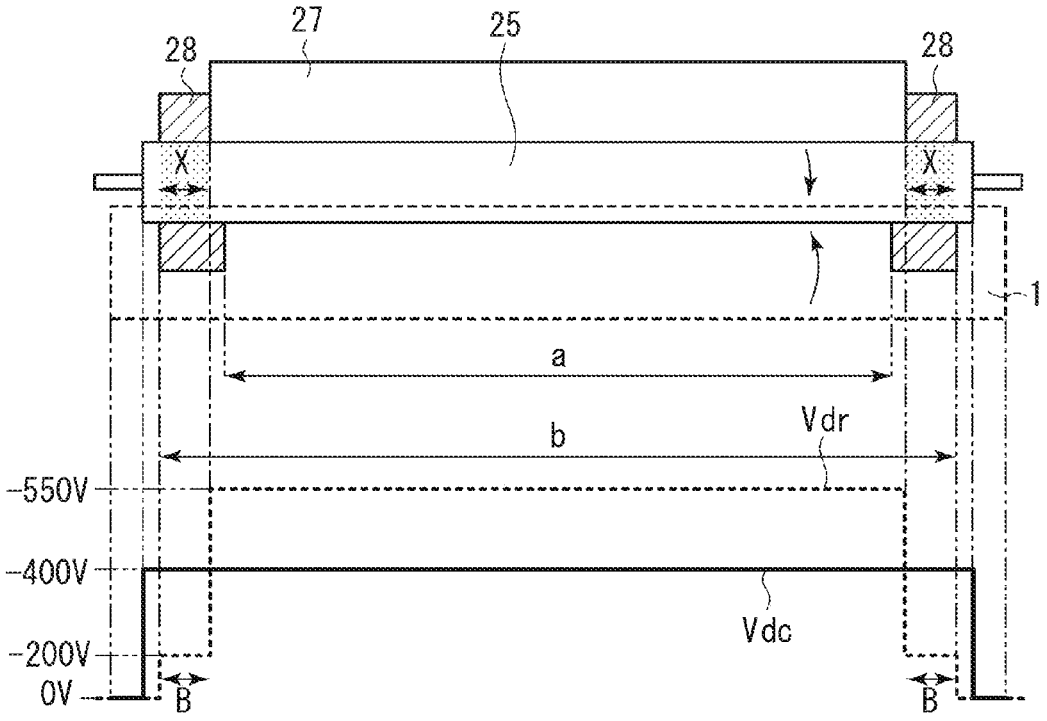
FIG. 8 illustrates an example of a longitudinal potential relationship according to a second exemplary embodiment.

A second exemplary embodiment of the present invention will be described below. An image formation process, a development process, and a development device in the present exemplary embodiment are similar to those in the first exemplary embodiment. Potential control, which characterizes the present exemplary embodiment, will be described with reference to FIG. 8. FIG. 8 illustrates potential control that is performed when a charging region b has a width including an X portion, which is different from the configuration in FIG. 7. The X portion in an upper part of FIG. 8 represents a region coated with a lubricant having a positive polarity. A B portion in a lower part of FIG. 8 shows a potential relationship corresponding to the X portion illustrated in FIG. 8. The charging region b in FIG. 8 is longer than that in FIG. 7. Thus, a surface potential Vdr of a photosensitive drum 1 in the B portion becomes −550 V in a non-exposure state. In this state, a surface potential Vdc of a development roller 25 and the surface potential Vdr are respectively −400 V and −550 V, and a potential difference therebetween is Vdr−Vdc=−150 V. If the potential difference is thus opposite in polarity to the lubricant, the lubricant coated on the X portion on the development roller 25 is developed onto the photosensitive drum 1. As a result, the lubricant may not exist on the development roller 25 and the surface of the development roller 25 may be cracked. To that end, in a region corresponding to the B portion, an exposure device (not illustrated) performs laser exposure to lower the surface potential Vdr to −200 V. Then, in the portion B, the surface potentials Vdc and Vdr are respectively −400 V and −200 V, and a potential difference therebetween is Vdr−Vdc=+200 V. When laser exposure is thus performed in the B portion, the potential difference can be controlled (changed) so as to obtain the same polarity as that of the lubricant, and the lubricant remains on the development roller 25 without being developed onto the photosensitive drum 1. Accordingly, the lubricant remains in the X portion and reduces sliding. Thus, the surface of the development roller 25 can be prohibited from being cracked. Therefore, a high-quality image output is obtained over a long period of time.

FIG. 8 illustrates a potential relationship at ends of the development roller 25, and does not illustrate a potential relationship corresponding to an image formation region a illustrated in FIG. 8. Therefore, a potential relationship in the image formation region a does not limit the present exemplary embodiment regardless of whether it is during image formation or non-image formation.

A third exemplary embodiment of the present invention will be described below. According to the present exemplary embodiment, a positional relationship among an end in a longitudinal direction of a development roller 25, an end of a photosensitive drum 1, an end of an end seal 28, and an end of a regulation blade 27 will be described with reference to FIGS. 9 and 10.

Figure 9:
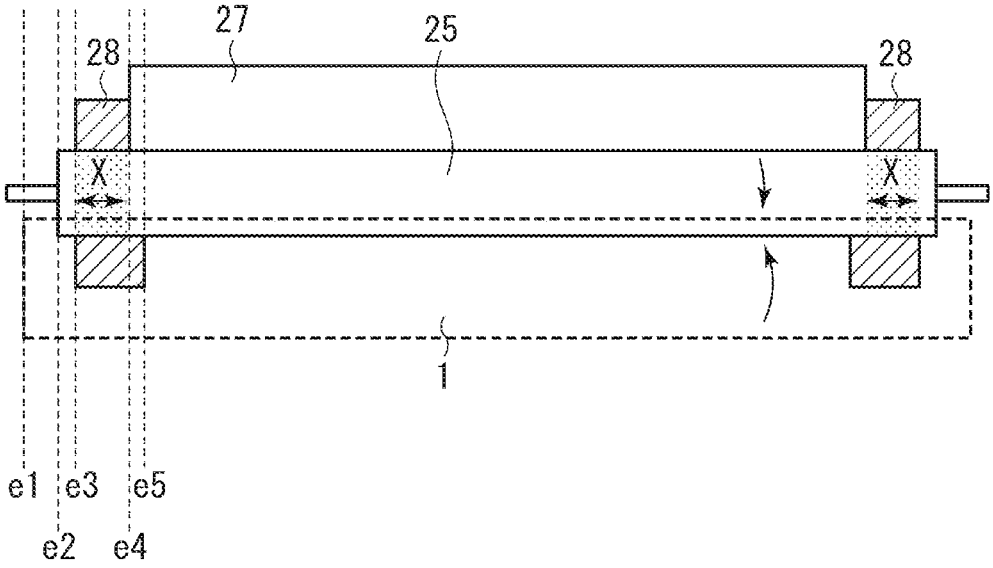
FIG. 9 illustrates an example of a positional relationship at a longitudinal end according to a third exemplary embodiment.

FIG. 9 illustrates a configuration according to the first exemplary embodiment. Regarding a positional relationship of each of the components on the left side, an end (e1) of the photosensitive drum 1, an end (e2) of the development roller 25, and an outer end (e3) of the end seal 28 are arranged in this order from outside to inside in the longitudinal direction. Further, an end (e4) of the regulation blade 27 and an inner end (e5) of the end seal 28 are arranged in this order. The components on the right side are arranged in a similar order toward the center from outside.

There is at least a lubricant between the outer end (e3) of the end seal 28 and the end (e4) of the regulation blade 27. Thus, cracks or scratches on the development roller 25 can be reduced, and thus, toner leakage can be reduced. The width between the outer end (e3) of the end seal 28 and the end (e4) of the regulation blade 27 is narrow. For this reason, if it is difficult to apply the lubricant to the development roller 25 in a manufacturing process, the lubricant may be applied between the end (e4) of the regulation blade 27 and the inner end (e5) of the end seal 28, and be also applied inside the inner end (e5) of the end seal 28. The toner and the lubricant are opposite in polarity. Thus, the toner and the lubricant are hardly simultaneously conveyed to the photosensitive drum 1 during image formation, without much affecting an output image. Consequently, the lubricant may be applied to a surface region of the development roller 25 corresponding to an image formation region inside the inner end (e5) of the end seal 28.

Figure 10:
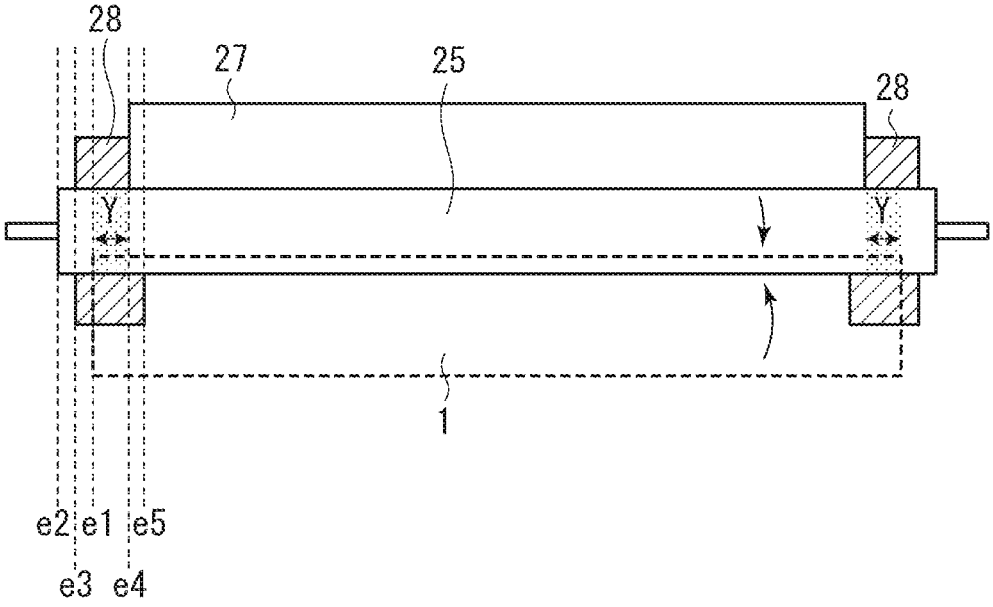
FIG. 10 illustrates another example of the positional relationship at the longitudinal end according to the third exemplary embodiment.

FIG. 10 illustrates a modified example of the first exemplary embodiment. The end (e1) of the photosensitive drum 1 is positioned inside the end (e2) of the development roller 25. Thus, at least the lubricant may exist between the end (e1) of the photosensitive drum 1 and the end (e4) of the regulation blade 27. In such a configuration, a region on the development roller 25, to which the lubricant is applied can be made narrower than the width of the end seal 28 (between the end e3 and the end e5), and an application amount of the lubricant can be reduced. Thus, the cost can be reduced. If the cost is not taken into consideration, the lubricant may be applied inside the end (e4) of the regulation blade 27.

The lubricant may be applied to an area on the development roller 25 surface that corresponds to the area between the outer end (e3) of the adjacent end seal 28 and the end (e1) of the photosensitive drum 1. With this, if an amount of the lubricant remaining between the end (e1) of the photosensitive drum 1 and the end (e4) of the regulation blade 27 decreases, a lubricant on an adjacent region may enter into the area. Accordingly, stability can be maintained over a long period of time.

An example is described in which the lubricant opposite in polarity to the developer is arranged on the surface of the developer bearing member which contacts the image bearing member and the end seal when the developer bearing member rotates. However, the present invention is not limited to this arrangement. If a potential on the surface of the developer bearing member has the same polarity as that of a potential difference obtained by subtracting a potential of the developer bearing member from a potential of the image bearing member, and if there is a lubricating substance (including toner) on the surface of the developer bearing member, a similar effect can be obtained.

When the lubricant opposite in polarity to the developer exists on the surface of the developer bearing member, as described above, the lubricant remains on the surface of the developer bearing member over a long period of time. Consequently a lubricating effect is continued, which reduces the possibility that the surface of the developer bearing member is cracked or scratched and the developer leaks out via cracks or scratches.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-181361, filed Sep. 5, 2014, which is hereby incorporated by reference herein in its entirety.

What is claimed is:

1. A development device comprising:

a developer bearing member arranged to contact an image bearing member and configured to convey developer;

a development container configured to contain the developer; and an end seal configured to contact the developer bearing member to prevent the developer from leaking from between an end of the developer bearing member in a longitudinal direction and the development container, wherein a lubricant, having a charge polarity that is opposite to a charge polarity of the developer, is applied onto at least a part of a surface of the developer bearing member, and wherein the part of the surface of the developer bearing member contacts the image bearing member and the end seal in a case where the developer bearing member rotates.

2. The development device according to claim 1, wherein a potential of the image bearing member and a potential of the developer bearing member are controlled such that the charge polarity of the lubricant equals to a determined polarity of a potential difference obtained by subtracting the potential of the developer bearing member from the potential of the image bearing member.

3. The development device according to claim 2, wherein the image bearing member is exposed to light by an exposure device to change the potential of the image bearing member.

4. The development device according to claim 1, wherein the charge polarity of the lubricant is a positive polarity and the charge polarity of the developer is a negative polarity.

5. The development device according to claim 1, further comprising a regulation member configured to regulate an amount of the developer borne on the surface of the developer bearing member.

6. The development device according to claim 5, wherein, in a positional relationship in the longitudinal direction of the developer bearing member, an end of the image bearing member, an end of the developer bearing member, and an outer end of the end seal are positioned from outside to inside in the order of the end of the image bearing member, the end of the developer bearing member, and the outer end of the end seal.

7. The development device according to claim 5, wherein in a positional relationship in the longitudinal direction of the developer bearing member, an end of the image bearing member, an end of the developer bearing member, and an outer end of the end seal are positioned from outside to inside in the order of the end of the developer bearing member, the outer end of the end seal, and the end of the image bearing member.

8. The development device according to claim 1, wherein the lubricant exists inside the longitudinal end of the image bearing member in the longitudinal direction of the developer bearing member.

9. The development device according to claim 1, wherein the lubricant exists inside an outer end of the end seal in the longitudinal direction of the developer bearing member.

10. The development device according to claim 1, wherein the lubricant exists on a surface corresponding to an image formation region of the developer bearing member.

11. A process cartridge comprising:

the development device according to claim 1; and the image bearing member configured to bear a developer image formed with the developer.

12. An image forming apparatus comprising:

the development device according to claim 1; and an image, wherein the image is formed with the developer on a transfer material.

13. The development device according to claim 1, wherein the lubricant is coated onto the part of a surface of the developer bearing member where the developer bearing member contacts the image bearing member and the end seal and does not contact a regulation member.

* * * * *